US010973111B2

(12) United States Patent
Heuft et al.

(10) Patent No.: US 10,973,111 B2
(45) Date of Patent: Apr. 6, 2021

(54) COOLING DEVICE FOR X-RAY GENERATORS

(71) Applicant: HEUFT SYSTEMTECHNIK GMBH, Burgbrohl (DE)

(72) Inventors: Bernhard Heuft, Burgbrohl (DE); Wolfgang Polster, Andernach (DE)

(73) Assignee: Heuft Systemtechnik GmbH, Burgbrohl (DE)

( * ) Notice: Subject to any disclaimer, the term of this patent is extended or adjusted under 35 U.S.C. 154(b) by 0 days.

(21) Appl. No.: 16/490,234

(22) PCT Filed: Mar. 6, 2018

(86) PCT No.: PCT/EP2018/055393
§ 371 (c)(1),
(2) Date: Aug. 30, 2019

(87) PCT Pub. No.: WO2018/162437
PCT Pub. Date: Sep. 13, 2018

(65) Prior Publication Data

US 2020/0008287 A1 Jan. 2, 2020

(30) Foreign Application Priority Data

Mar. 8, 2017 (DE) ..... 10 2017 002 210.0

(51) Int. Cl.
*H05G 1/02* (2006.01)
*H05G 1/04* (2006.01)

(52) U.S. Cl.
CPC ..... *H05G 1/025* (2013.01); *H05G 1/04* (2013.01)

(58) Field of Classification Search
None
See application file for complete search history.

(56) References Cited

U.S. PATENT DOCUMENTS 2,089,723 A 8/1937 Vierkotter
2,482,275 A * 9/1949 Horsley ..... H01J 35/02 378/136

(Continued)

FOREIGN PATENT DOCUMENTS

DE 392701 C 3/1924
DE 612422 C 4/1935

(Continued)

OTHER PUBLICATIONS

English translation of International Preliminary Report on Patentability issued in related application PCT/EP2018/055393, dated Sep. 10, 2019, 8 pages.

*Primary Examiner* — Thomas R Artman
(74) *Attorney, Agent, or Firm* — Faegre Drinker Biddle & Reath LLP

(57) ABSTRACT

A cooling device for x-ray tubes in x-ray generators, comprising a housing with a central receiving device for receiving an x-ray tube with an inlet opening for supplying a gaseous coolant, an outlet opening for discharging the gaseous coolant, and a gas-conducting channel which extends between the inlet opening and the outlet opening. The gas-conducting channel is designed to conduct the gaseous coolant directly by the high-voltage x-ray tube housing during operation. The gas-conducting channel additionally extends in a helical manner about the x-ray tubes such that the electric potential applied to the x-ray tubes drops to zero potential along the gas-conducting channel.

17 Claims, 6 Drawing Sheets

(56) References Cited

U.S. PATENT DOCUMENTS

| | | | | |
|---|---|---|---|---|
| 4,264,818 | A * | 4/1981 | Petersen | H01J 35/12 378/141 |
| 4,355,410 | A | 10/1982 | Sullins | |
| 4,768,212 | A | 8/1988 | Appelt et al. | |
| 4,780,901 | A | 10/1988 | Gabbay et al. | |
| 4,884,292 | A | 11/1989 | Klostermann | |
| 6,185,279 | B1 * | 2/2001 | Chambron | G21K 1/04 378/140 |
| 6,426,998 | B1 | 7/2002 | Hell et al. | |
| 6,477,236 | B1 * | 11/2002 | Anno | H01J 35/105 378/127 |
| 2016/0029468 | A1 | 1/2016 | Anno et al. | |
| 2020/0008287 | A1 * | 1/2020 | Heuft | H05G 1/025 |

FOREIGN PATENT DOCUMENTS

| | | | |
|---|---|---|---|
| DE | 8615918 | U1 | 10/1987 |
| DE | 298 23 735 | U1 | 11/1999 |
| DE | 199 29 655 | A1 | 1/2000 |
| GB | 1 228 446 | A | 4/1971 |

* cited by examiner

COOLING DEVICE FOR X-RAY GENERATORS

CROSS-REFERENCE TO RELATED APPLICATIONS

This application is the U.S. national phase of the International Patent Application No. PCT/EP2018/055393 filed Mar. 6, 2018, which claims the priority benefit of German Patent Application No. 10 2017 002 210.0 filed Mar. 8, 2017, the contents of all being incorporated herein by reference.

FIELD

The present application relates to a device for cooling x-ray tubes in x-ray generators using a gaseous cooling medium as coolant. The ambient air is preferably used as coolant. Further preferably, the x-ray generators are compact x-ray generators for applications in the field of the food industry.

BACKGROUND

Conventional x-ray tubes comprise an evacuated tube in which an electric filament for generating free electrons and, spaced apart therefrom, an anode are located. The electrons emitted by the filament are accelerated by an additionally applied high voltage in the electric field and are directed onto the anode. The collision between the rapid electrons and the anode leads to the generation of x-ray radiation. The x-ray radiation generated in this way can be used for the examination or treatment of people, animals or objects.

The bombardment of the anode with electrons additionally leads to the anode heating up, as most of the kinetic energy of the incident electrons is converted into heat. The quantity of heat released in the anode is dependent on the speed and number of incident electrons. In order to prevent the anode, and thus the whole x-ray tube, from heating up too strongly during operation, the quantity of heat generated must be dissipated from the x-ray tube.

For this, various types of cooling systems are used, depending on the power of the x-ray tube. When designing cooling devices for high-voltage components such as x-ray tubes it is always to be borne in mind that the x-ray electrode is at high voltage potential and that an adequate insulation of the x-ray electrode from the surroundings must be ensured.

In order to achieve effective cooling, a liquid coolant is usually introduced between an outer housing wall of the cooling device and the outer wall of the x-ray tube. An oil with a high dielectric constant is frequently used as coolant, with the result that the coolant at the same time also serves for the electrical insulation of the x-ray tube at high voltage during operation. Such a device is described in U.S. Pat. No. 4,780,901 (A), in which a dielectric oil is used as electrically insulating coolant.

A liquid-cooled x-ray radiator is known from the German utility model DE 86 15 918.6. The x-ray radiator is arranged in a housing filled with an insulating oil. In addition, a circulation cooling system is provided which has a cooler connected to the housing by two coolant lines and a circulating pump for the insulating oil. The insulating oil circulates freely around the x-ray radiator inside the housing. Outside the housing, the insulating oil is conducted via the coolant lines to the circulating pump. The coolant lines can be guided past a fan. In order to cool the coolant as effectively as possible, the coolant lines can run spirally in the region of the fan and be provided with cooling fins. The spiral course of the coolant lines serves to increase the surface area that can be used for the cooling in order to increase the dissipation of heat from the coolant to the surroundings.

Such dielectric oils permit a very steep potential curve within the coolant between high-voltage components and components at ground potential, without there being the danger of a spark discharge. A steep potential curve permits a correspondingly compact design, as very short spatial distances between high-voltage components (outer wall of the evacuated x-ray tube) and components at ground potential, i.e. zero potential, (outer walls of the housing of the cooling device) are permitted.

Especially in the field of the food or pharmaceuticals industries, however, oil-cooled systems are often disadvantageous since, in the case of leakiness, there is the danger of contamination of food or medicinal products with the oil, which is generally harmful to health. In addition, oil-cooled systems are also generally relatively high-maintenance because of the oil changes to be carried out regularly.

In principle it would be entirely possible to use air-cooling systems for x-ray tubes. However, air has poorer insulating properties. For dry air, a dielectric strength of approximately 1 kV/mm (kilovolt per millimetre) can be assumed. In order to reliably avoid a spark discharge under real conditions, distances greater by a factor of three must be provided to counter it. For typically used 100 kV x-ray tubes, a distance to be maintained of approximately 30 cm thus results between an x-ray tube at high voltage and the housing of the x-ray generator at ground potential.

Conventional air-cooled systems must thus have correspondingly larger dimensions and are thus, particularly in the case of very high operating voltages, more unwieldy and less flexible to use.

Gaseous cooling media are usually only used for external cooling in the case of conventional x-ray tubes. For example, ambient air is guided along the outer side of the x-ray radiator which is at ground potential. These devices are suitable for use when only relatively small quantities of heat need to be transported away. As the cooling is also effected from the outside, the cooling medium also does not need to have any electrical insulating properties. Such x-ray radiators are known for example from U.S. Pat. No. 4,884,292 or 4,355,410.

An x-ray tube, more precisely a rotary piston x-ray radiator, in which a gaseous cooling medium is used, is known from DE 298 23 735 U1. In the device described there, the cooling gas is conducted paraxially into the interior of the housing. The cooling gas serves both for cooling and for the electrical insulation of the high-voltage components from the housing. For this reason, it is also not possible to use any desired cooling gas here, but rather the cooling gas must be a high-voltage-insulating cooling gas. Sulfur hexafluoride ($SF_6$) is named in that document as the sole example of such a gas. Since strict safety guidelines must be met when using this gas and since this gas is one of the strongest known greenhouse gases, use of this coolant is not desired.

SUMMARY

An object of the present disclosure is therefore to provide a cooling device for x-ray generators which requires less maintenance than oil-based cooling devices but which nevertheless enables a compact design. A further object of the present disclosure is to provide a cooling device for x-ray generators in which any desired gaseous coolant can be used.

This object is achieved in the device of the type named at the beginning by the features according to claim 1.

The cooling device comprises a housing with an inlet opening, an outlet opening and a gas-conducting channel, which extends between the inlet opening and the outlet opening. A central receiving device for receiving an x-ray tube is provided. The gas-conducting channel is designed such that it guides the gaseous cooling medium directly past the high-voltage housing of the x-ray tube during operation. The cooling medium absorbs the heat produced by the x-ray tube and dissipates it towards the outside. Nevertheless, the gaseous cooling medium does come into contact with high-voltage housing parts of the x-ray tube. In order to avoid sparking along the gas-conducting channel, the cooling gas is not guided past the x-ray tube on a direct radial route but is guided through the housing of the cooling device on a spirally running path. Due to the spiral course, the actual length of the gas-conducting channel is greatly lengthened, with the result that, in spite of a compact design, a sufficiently large effective distance between the high-voltage components of the x-ray tube and the housing parts at ground potential can be provided.

The term "spiral" as used in the present description is to be understood broadly and is intended to comprise substantially any desired routing in which the cooling gas is not guided through the cooling device on a direct radial route. For example, the "spiral routing" could also be designed such that the gaseous cooling medium is guided to the x-ray tube housing on a winding or meandering path which runs only on one side of the cooling device and that the cooling medium is then guided towards the outside on a similarly shaped path which, however, runs only in the other half of the cooling device. In principle, the term "spiral routing" can also mean any desired 3D labyrinth structure which makes it possible to obtain a sufficiently large effective distance between the high-voltage components of the x-ray tube and the housing parts at ground potential.

In the most preferred embodiment of the present disclosure, however, the spiral path actually has the shape of a geometric spiral and has a plurality of windings which extend around the x-ray tube arranged centrally during operation.

The cooling gas can be substantially any desired gaseous medium. A particularly suitable cooling gas is ambient air, as this permits particularly simple and cost-effective cooling. However, pure gases such as nitrogen, helium, argon or $CO_2$ can also be used. In particular, the design according to the disclosure of the gas-conducting channel enables any desired cooling gases to be used, or also those cooling gases to be used which cannot be used in conventional systems because of their low dielectric strength. In particular when ambient air is used as cooling gas, no cooling gas-specific safety precautions need to be taken, with the result that in this case the cooling can be used particularly variably and cost-effectively.

X-ray tubes are usually operated at high voltages between 10 and 200 kV. The high voltage used and the cooling gas substantially determine how long the gas-conducting channel must be made. In order to be able to use the cooling device as flexibly as possible, the gas-conducting channel should be long enough that no sparking along the gas-conducting channel can occur even at the maximum applicable high voltage and at maximum humidity.

The housing of the cooling device is produced from electrically insulating material. The housing preferably consists of thermoplastic such as polycarbonate, polysulfone, PVC or polyolefins, of Plexiglas or of polyoxymethylene. Plastic composites or plastic-ceramic composites can also be used as housing material. When the generated x-ray radiation is guided through the housing, the absorption of the x-ray radiation can be influenced in a targeted manner via the choice of the housing material. For example, x-ray absorbing materials can be used in order to obtain a specific or desired cross section of the x-ray beam.

The gas-conducting channel is preferably formed of two spirally arranged inner walls of the housing of the cooling device. The inner walls define a first spiral path, on which the cooling gas is conducted into the central area of the housing in which the x-ray tube is located during operation. At the same time, the inner walls define a second spiral path, on which the cooling gas is conducted out of the housing from the central area of the housing.

The thickness of the inner walls to be used depends on the high voltage used and on the housing material used. The total wall thickness, thus the sum of all wall thicknesses in the radial direction, must be chosen sufficiently large, with the result that, in the case of the high voltage used in each case, a radial sparking is prevented through the walls of the cooling device. The dielectric strength of the typically used wall material is approximately 10 times greater than the dielectric strength of the cooling gas and lies in the range of approximately 25 to 120 kV/mm. In order to prevent arcing, total wall thicknesses of approx. 0.5 to 3 cm are therefore usually to be used, which results in a wall thickness of from 1 to 3 mm for the individual inner and outer walls of the cooling device.

In a preferred embodiment, the housing of the cooling device is designed in two parts. The two housing parts can be reversibly connected to each other. The connection can be a plug-in connection, for example. Each of the housing parts which can be connected to each other preferably comprises spiral inner walls which, in the assembled state, engage in one another and thereby define the gas-conducting channel. A two-part housing is particularly easy to maintain since access to the interior of the cooling device can be gained at any time.

Further preferably, in the case of the two-part embodiment, one housing part is connected to the x-ray tube, while the other housing part is connected to the high-voltage power supply unit, for example. Here, the x-ray tube can be permanently connected to the respective housing part. In the case of a defect in the x-ray tube, the x-ray tube can be replaced together with the respective housing part. To exchange the defective x-ray tube, only the part of the two-part cooling housing connected to the x-ray tube needs to be removed and replaced by a corresponding replacement part. In this way, the two-part cooling device likewise makes maintenance of the x-ray system easier.

In a further embodiment, the gas-conducting channel can also be realized in the form of a wound-up hose structure. Such hose structures can be produced both on the basis of rectangular basic hose shapes and on the basis of round or elliptical basic hose shapes. The hose structures can then be fixed in a suitable manner. For this purpose, the hose structures can be glued or be provided with a suitable housing.

According to a further aspect, the present disclosure also relates to an x-ray generator comprising an above-described cooling device, a high-voltage generator and an x-ray tube. The high-voltage generator generates the high voltage necessary for the operation of the x-ray tube. The x-ray tube can be mechanically and electrically connected to the high-voltage generator via a central high-voltage contact. The cooling device extends radially around the x-ray tube, with the result that the x-ray tube is cooled and at the same time is electrically shielded.

The present disclosure moreover also relates to a method for cooling an x-ray generator. A high-voltage generator for generating a high voltage is provided. An x-ray tube is mechanically and electrically connected to the high-voltage generator via a high-voltage contact. An above-described cooling device is provided, wherein the gas-conducting channel defined by the cooling device extends spirally around the x-ray tube in order to cool the x-ray tube and at the same time to shield it electrically. A gaseous cooling fluid is conducted through the cooling system for cooling the x-ray generator.

The cooling power that can be achieved using the gaseous cooling fluid is less than the cooling power that can be reached with liquid coolants and is up to 40 W, preferably between 0.5 and 25 Watts and further preferably 1 to 12 W.

As already mentioned, a large part of the energy expended in an x-ray generator is converted into heat. In order to save energy and to produce as little excess heat energy as possible, an x-ray tube can also be operated in pulsed mode, in that the x-ray radiation is generated in each case only for a short time. Much less waste heat is generated by pulsed-mode operation than in the case of a continuous-wave operation. In this way, a relatively high-powered x-ray tube can be used which, however, nevertheless generates much less waste heat than a corresponding x-ray tube actuated in continuous-wave operation. With suitable dimensioning, the cooling device according to the disclosure can therefore be used particularly advantageously in pulsed-mode operation in relatively high-powered x-ray generators.

Features which are described in connection with individual embodiments can, unless otherwise indicated, also be used in connection with other embodiments.

BRIEF DESCRIPTION OF THE DRAWINGS

Embodiment examples of the disclosure are explained in the following with reference to the drawings, in which.

DETAILED DESCRIPTION

Figure 1:
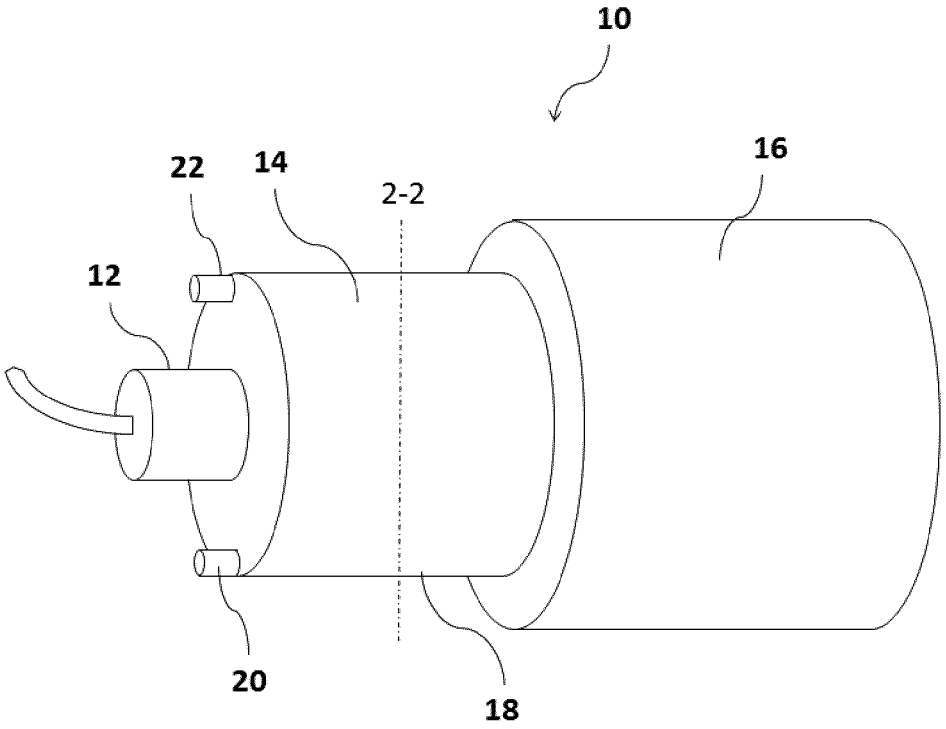
FIG. 1 is a structure of a cooling device according to the disclosure in an x-ray generator.

FIG. 1 shows an arrangement 10 according to the disclosure for generating x-ray radiation, comprising an x-ray tube 12, a cooling device 14 and a high-voltage source 16. The cooling device 14 extends around part of the x-ray tube 12 and serves both for cooling and for electrical insulation of the x-ray tube 12 from the surroundings.

The cooling device 14 has a housing 18 with a gas inlet opening 20 and a gas outlet opening 22 for supplying or for discharging the gaseous coolant. In the interior of the cooling device 14, the coolant is guided past the x-ray tube 12 on a spiral path in a gas-conducting channel 24. The coolant absorbs the heat generated by the x-ray tube 12 and dissipates it to the surroundings.

The x-ray tube 12 is usually operated at a high voltage of between 20 and 150 kV. The required high voltage is provided by the high-voltage source 16 and applied to the x-ray tube 12 via a correspondingly provided contacting. In order to guarantee the operational safety of the arrangement, the accessible housing parts, in particular the housing 18 of the cooling device 14, are connected to ground.

The cooling device 14 therefore not only needs to be designed such that the heat generated by the x-ray tube 12 can be dissipated but must at the same time also insulate the x-ray tube 12 electrically with respect to the surroundings.

The housing 18 of the cooling device 14 is therefore expediently manufactured from thermoplastic, e.g. from polysulfone. In the embodiment shown in FIG. 1, the gas inlet opening 20 and the gas outlet opening 22 are each located on an end wall of the housing 18 of the cooling device 14.

Figure 2:
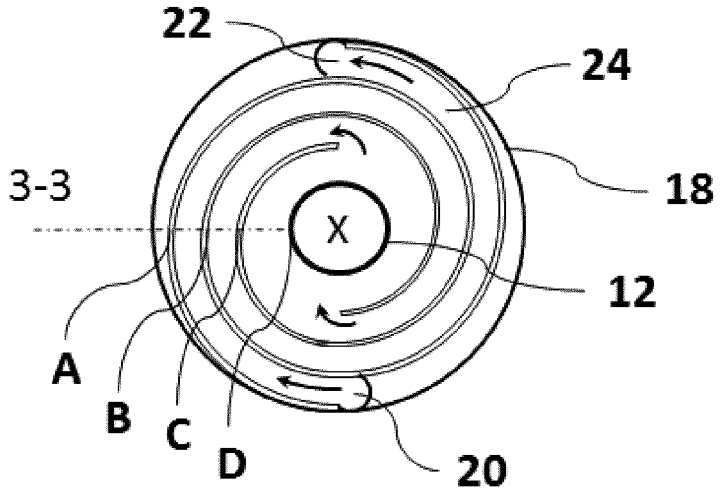
FIG. 2 is a radial cross section of the cooling device according to the disclosure along the broken line 2-2 from FIG. 1.

The course of the gas-conducting channel 24 in the interior of the cooling device 14 is depicted in the cross section of FIG. 2. The cross section is taken along the line 2-2 from FIG. 1. The cooling gas is conducted from the gas inlet opening 20 along the spiral gas-conducting channel 24 through the housing 18 of the cooling device 14. In the centre of the cooling device 14, the cooling gas enters into a heat exchange relationship with the x-ray tube 12 and absorbs heat generated by the x-ray tube 12. The heated cooling gas is then guided further through the gas-conducting channel 24 until it finally exits the housing 18 of the cooling device 14 at the gas outlet opening 22. The inner walls of the cooling device, which are arranged helically and define the gas-conducting channel 24, predefine the route of the gas stream by means of their spiral arrangement.

The length of the gas-conducting channel 24 must be dimensioned such that sparking between the centrally arranged x-ray tube 12 at high-voltage potential and the outside of the housing 18 of the cooling device 14 at ground potential is prevented.

The minimum length of the gas-conducting channel to be used in each case depends on the level of the operating voltage of the x-ray tube. In general it can be said that the length of the gas-conducting channel should be approximately 3 mm/kV. In the case of a 100-kV x-ray tube this means that the length of the gas-conducting channel between the centrally arranged x-ray tube and the gas inlet opening or the gas outlet opening should be approximately 30 cm.

In order to guarantee the operational safety of the arrangement 10, not only must the spiral gas-conducting channel 24 of the cooling device 14 be designed sufficiently long but it must also be ensured that no sparking can occur in the radial direction through the inner and outer walls of the housing 18 of the cooling device 14.

In order to prevent such radial sparking, the sum of the wall thicknesses of the gas-conducting channel 24 in the radial direction of the cooling device 14 must be chosen such that the resulting total wall thickness prevents such sparking. The required total thickness of the walls depends on the dielectric properties of the material which is used for the housing 18 of the cooling device 14. Typically used thermoplastics have a dielectric strength of from 10 to 20 kV/mm. For a 100-kV x-ray tube this in turn means that a total wall thickness of approximately 10 mm should be provided in order to also prevent radial sparking.

Figure 3:
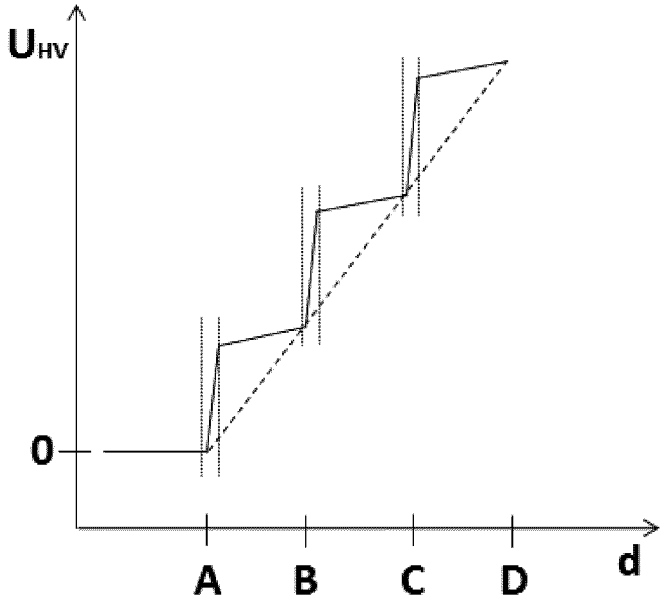
FIG. 3 is a schematic curve of the electrical potential through the inside of the cooling device according to the disclosure.

The curve of the electrostatic potential in the radial direction along the line 3-3 of FIG. 2 is represented by way of example in FIG. 3. The line 3-3 runs in the radial direction from the outside of the housing 18 through three wall areas A, B, C to the x-ray tube 12. On this route, the entire high-voltage potential of the x-ray tube drops to ground. Because of the much higher dielectric constant of the plastic material of the cooling device 14 compared with the dielectric constant of air, there is a much steeper drop in potential within the wall areas A, B, C than inside the gas-conducting channel 24. As can be seen from the potential curve in FIG. 3, the total thickness of the wall areas is dimensioned sufficiently, with the result that the entire electric potential of the x-ray tube can drop in the radial direction over the wall areas without arcing occurring.

Figure 4:
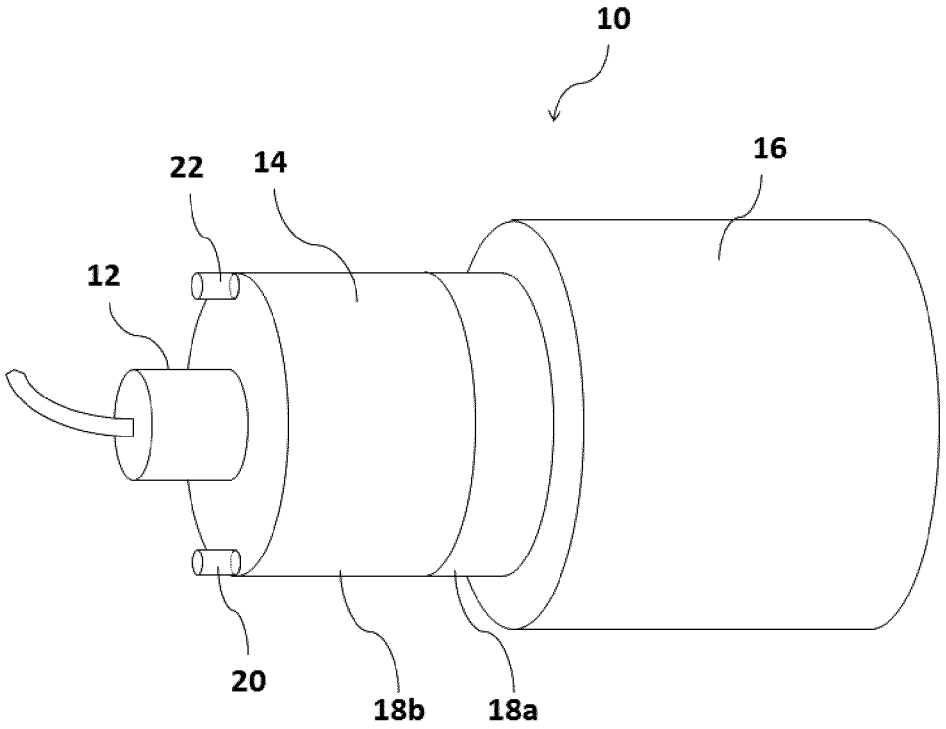
FIG. 4 is a two-part embodiment of the cooling device according to the disclosure.
Figure 5:
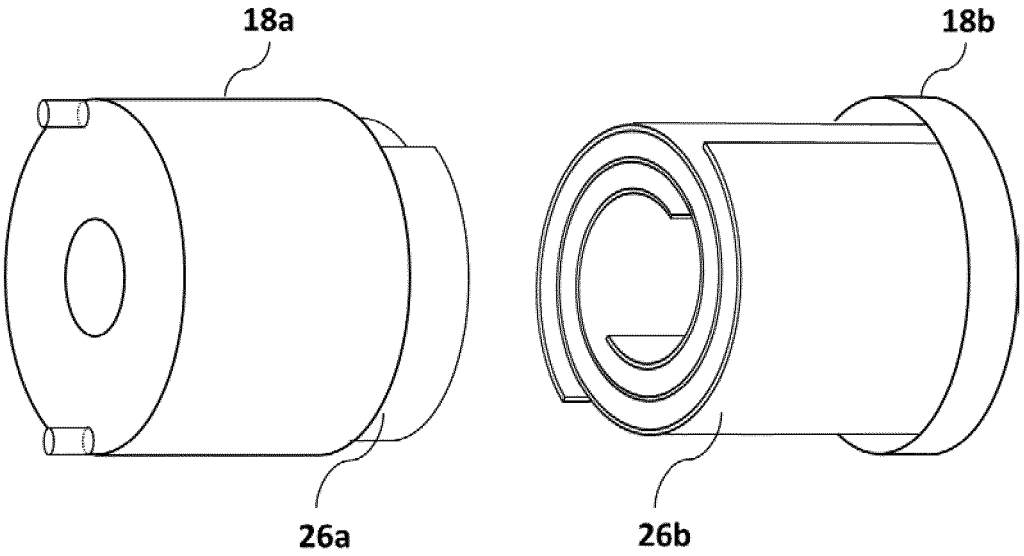
FIG. 5 is the two housing parts of the embodiment according to FIG. 4.
Figure 6:
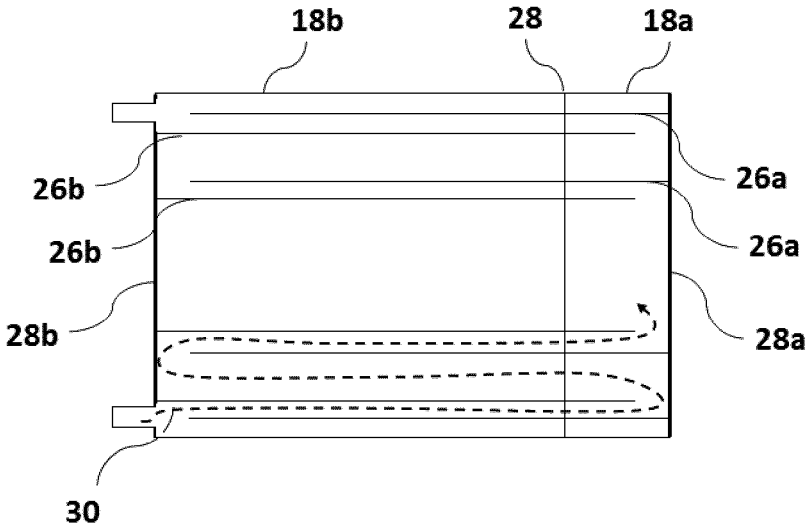
FIG. 6 is an axial cross section through the cooling device according to FIG. 4.

FIGS. 4 to 6 show a preferred embodiment of the present disclosure in which the housing 18 of the cooling device 14 is designed in two parts. One part 18*a* of the housing of the cooling device 14 is connected to the high-voltage generator 16. The other part 18*b* of the housing 18 is connected to the x-ray tube 12. As illustrated in FIG. 5, the two housing parts 18*a*, 18*b* each comprise spirally arranged inner walls 26*a*, 26*b* which define the spiral gas-conducting channel 24. The outer walls of the two housing components 18*a*, 18*b* are designed such that they form a stable plug-in connection. In the assembled state, the spiral inner walls 26*a*, 26*b* engage in each other in the axial direction such that the free ends of the inner walls of one housing part 18*a*, 18*b* reach in each case to the end wall 28*b*, 28*a* of the respectively other housing part 18*b*, 18*a*. The thus-defined gas-conducting channel 24 substantially corresponds to the gas-conducting channel 24 as it was described with reference to FIGS. 1 to 3.

In order to prevent sparking also in this embodiment of the cooling device 14, the same criteria as in the previously described embodiment apply to the length of the gas-conducting channel 24 and to the sum of the wall thicknesses in the radial direction.

FIG. 6 shows a cross section in the axial direction through a cooling device designed in two parts. As already discussed above, although the spiral inner walls 26*a*, 26*b* of the individual housing parts 18*a*, 18*b* extend in each case to the end walls 28*b*, 28*a* of the respectively other housing part 18*b*, 18*a*, an airtight connection is not absolutely necessary to achieve the cooling effect of the present disclosure. However, a non-airtight connection between the two housing parts opens up a further potential route for sparking through the cooling device.

This potential route for sparking is represented in FIG. 6. The two housing parts 18*a* and 18*b* each have a circular end wall 28*a* and 28*b*. The spiral inner walls 26*a* and 26*b* which form the gas-conducting channel 24 extend in each case from this end wall. The size of the axial extent of the inner walls 26*a* and 26*b* in each case is such that the free ends thereof touch the respectively opposite end wall 28*b* and 28*a*, with the result that in this embodiment too the gaseous cooling medium is substantially conducted along the thus-formed gas-conducting channel 24.

Remaining interspaces between the free ends of the inner walls 26*a* and 26*b* and the respectively opposite end walls 28*a* and 28*b* are represented exaggerated in FIG. 6 for reasons of clarity. In actual cooling devices, at the most narrow slits would occur, which would allow only a very small quantity of cooling fluid to pass through.

However, even narrow slits would be sufficient to make sparking possible. A potential spark path is drawn in as a broken line in FIG. 6. Since narrow slits between the housing parts cannot be avoided or are to be accepted because of the negligible impact on the cooling effect, in this embodiment it must be ensured that the depth of the inner walls 26*a*, 26*b* of the two housing parts 28*a*, 28*b* engaging in each other is chosen such that the resulting spark gap is likewise again long enough to prevent sparking along the potential spark path drawn in FIG. 6 at the high voltages used.

Moreover, when non-hazardous cooling gases such as air or nitrogen are used it is also not absolutely necessary to ensure a completely gas-tight connection between the two housing parts 18*a* and 18*b*. Nevertheless, escaping cooling gas does mix with the ambient air, but does not lead to contamination of the components or of the products to be examined, in contrast to the dielectric oils otherwise usually used.

The above embodiments serve only to illustrate the present disclosure and are not to be interpreted as limiting. Of course, a person skilled in the art will also combine individual or all features which are described in connection with individual embodiments with other embodiments of the present disclosure.

LIST OF REFERENCE NUMERALS

10 x-ray generator arrangement
12 x-ray tube
14 cooling device
16 HV generator
18 housing of the cooling device
20 gas inlet opening
22 gas outlet opening
24 gas-conducting channel
26 inner walls of the housing
28 end walls of the housing
30 potential spark gap

The invention claimed is:

1. A cooling device for x-ray tubes in x-ray generators comprising a housing with a central receiving device for receiving an x-ray tube, an inlet opening for supplying a gaseous cooling medium, an outlet opening for discharging the gaseous cooling medium and a gas-conducting channel, which extends between the inlet opening and the outlet opening, wherein the gas-conducting channel is designed such that it guides the gaseous cooling medium directly past the high-voltage housing of the x-ray tube during operation, and wherein the gas-conducting channel extends spirally around the x-ray tube, with the result that the electric potential applied to the x-ray tube drops to zero potential along the gas-conducting channel, and the gas-conducting channel is formed of at least two spirally arranged inner walls of the housing of the cooling device.

2. The cooling device for x-ray generators according to claim 1, wherein the housing of the cooling device consists of electrically insulating material, including one or more thermoplastic materials including polycarbonate, PVC or polyolefins, of Plexiglas or of polyoxymethylene.

3. The cooling device for x-ray generators according to claim 1, wherein the thickness of the inner walls is chosen such that the sum of the wall thicknesses in the radial direction is sufficiently large, with the result that, in the case of the high voltage used in each case, a radial sparking is prevented through the inner walls.

4. The cooling device for x-ray generators according to claim 1, wherein the housing of the cooling device comprises two housing parts connected in a re-sealable manner, and each housing part comprises spiral inner walls which, in the assembled state, engage in one another and thereby define the gas-conducting channel.

5. The cooling device for x-ray generators according to claim 1, wherein one housing part of the cooling device is or can be connected to a high-voltage generator, and wherein the other housing part of the cooling device is or can be connected to an x-ray tube.

6. An x-ray generator comprising:

the cooling device according to claim 1, a high-voltage generator and an x-ray tube, wherein the high-voltage generator generates the high voltage necessary for the operation of the x-ray tube, wherein the x-ray tube is mechanically and electrically connected to the high-voltage generator via a high-voltage contact, and wherein the cooling device extends spirally around the x-ray tube in order to cool the x-ray tube and at the same time to shield it electrically.

7. A method for cooling an x-ray generator comprising the steps of:

providing a high-voltage generator for generating a high voltage, providing an x-ray tube which can be mechanically and electrically connected to the high-voltage generator via a high-voltage contact, providing a cooling device comprising a housing including a central receiving device for receiving an x-ray tube, an inlet opening for supplying a gaseous cooling medium, an outlet opening for discharging the gaseous cooling medium and a gas-conducting channel, which extends between the inlet opening and the outlet opening, wherein the gas-conducting channel is designed such that it guides the gaseous cooling medium directly past the high-voltage housing of the x-ray tube during operation, wherein the gas-conducting channel extends spirally around the x-ray tube, with the result that the electric potential applied to the x-ray tube drops to zero potential along the gas-conducting channel, and the gas-conducting channel is formed of at least two spirally arranged inner walls of the housing of the cooling device, wherein the gas-conducting channel of the cooling device extends spirally around the x-ray tube in order to cool the x-ray tube and at the same time to shield it electrically, wherein a gaseous cooling fluid is conducted through the cooling system for cooling the x-ray generator.

8. The method according to claim 7, wherein the cooling power of the cooling device provided by the gaseous cooling fluid is up to 40 W.

9. The method according to claim 7, wherein the x-ray tube is operated in pulsed mode, with the result that the generation of waste heat is reduced.

10. The method according to claim 8, wherein the x-ray tube is operated in pulsed mode, with the result that the generation of waste heat is reduced.

11. A cooling device for x-ray tubes in x-ray generators comprising a housing with a central receiving device for receiving an x-ray tube, an inlet opening for supplying a gaseous cooling medium, an outlet opening for discharging the gaseous cooling medium and a gas-conducting channel, which extends between the inlet opening and the outlet opening, wherein the gas-conducting channel is designed such that it guides the gaseous cooling medium directly past the high-voltage housing of the x-ray tube during operation, and wherein the gas-conducting channel extends spirally in a radial direction around the x-ray tube, with the result that the electric potential applied to the x-ray tube drops to zero potential along the gas-conducting channel.

12. The cooling device for x-ray generators according to claim 11, wherein the housing of the cooling device consists of electrically insulating material, including one or more thermoplastic materials including polycarbonate, PVC or polyolefins, of Plexiglas or of polyoxymethylene.

13. The cooling device for x-ray generators according to claim 11, wherein the gas-conducting channel is formed of at least two spirally arranged inner walls of the housing of the cooling device.

14. The cooling device for x-ray generators according to claim 11, wherein the device comprises the inner walls having a thickness chosen such that the sum of the wall thicknesses in the radial direction is sufficiently large, with the result that, in the case of the high voltage used in each case, a radial sparking is prevented through the inner walls.

15. The cooling device for x-ray generators according to claim 11, wherein the housing of the cooling device comprises two housing parts connected in a re-sealable manner, and each housing part comprises spiral inner walls which, in the assembled state, engage in one another and thereby define the gas-conducting channel.

16. The cooling device for x-ray generators according to claim 11, wherein one housing part of the cooling device is or can be connected to a high-voltage generator, and wherein the other housing part of the cooling device is or can be connected to an x-ray tube.

17. An x-ray generator comprising:

the cooling device according to claim 11, a high-voltage generator and an x-ray tube, wherein the high-voltage generator generates the high voltage necessary for the operation of the x-ray tube, wherein the x-ray tube is mechanically and electrically connected to the high-voltage generator via a high-voltage contact, and wherein the cooling device extends spirally around the x-ray tube in order to cool the x-ray tube and at the same time to shield it electrically.

* * * * *